US007317464B2

(12) United States Patent
Willis

(10) Patent No.: US 7,317,464 B2
(45) Date of Patent: Jan. 8, 2008

(54) PULSE WIDTH MODULATED SPATIAL LIGHT MODULATORS WITH OFFSET PULSES

(75) Inventor: Thomas E. Willis, Mountain View, CA (US)

(73) Assignee: Intel Corporation, Santa Clara, CA (US)

( * ) Notice: Subject to any disclaimer, the term of this patent is extended or adjusted under 35 U.S.C. 154(b) by 748 days.

(21) Appl. No.: 10/225,713

(22) Filed: Aug. 21, 2002

(65) Prior Publication Data

US 2004/0036707 A1 Feb. 26, 2004

(51) Int. Cl.
*G09G 5/10* (2006.01)

(52) U.S. Cl. ..... 345/691; 345/204

(58) Field of Classification Search ..... 345/204–215, 345/690–699

See application file for complete search history.

(56) References Cited

U.S. PATENT DOCUMENTS 4,907,862 A * 3/1990 Suntola ..... 349/61
5,428,366 A * 6/1995 Eichenlaub ..... 345/102
5,686,960 A * 11/1997 Sussman et al. ..... 348/218.1
5,731,802 A * 3/1998 Aras et al. ..... 345/692
6,049,325 A * 4/2000 Alexander ..... 345/157
6,091,853 A * 7/2000 Otto ..... 382/232
6,175,352 B1 * 1/2001 Kay et al. ..... 345/100
2003/0160804 A1 * 8/2003 Willis et al. ..... 345/694
2003/0193514 A1 * 10/2003 Huang ..... 345/694
2004/0046966 A1 * 3/2004 Fujita ..... 356/604

* cited by examiner

*Primary Examiner*—Vijay Shankar
(74) *Attorney, Agent, or Firm*—Kevin A. Reif

(57) ABSTRACT

In some embodiments, a display system includes a spatial light modulator including at least one pixel, a pixel source including pixel data corresponding to the pixel, a memory circuit connected to the pixel source and configured to store a pixel value corresponding to the pixel data, a pulse width modulation circuit connected between the memory circuit and the spatial light modulator, the pulse width modulation circuit adapted to generate a pulse to drive the pixel of the spatial light modulator, wherein a duration of the pulse corresponds to the pixel value and wherein the pulse is offset with respect to a start time and an end time of a refresh cycle of the spatial light modulator, and a control circuit connected to at least one of the memory circuit, the spatial light modulator, and the pulse width modulation circuit. Other embodiments are described and claimed.

20 Claims, 6 Drawing Sheets

PULSE WIDTH MODULATED SPATIAL LIGHT MODULATORS WITH OFFSET PULSES

BACKGROUND

1. Field of the Invention

The present invention relates to a method and an apparatus for pulse width modulating a display device such as a spatial light modulator.

2. Related Art

A spatial light modulator (SLM) is device which imparts information onto a light beam. For example, SLMs include liquid crystal devices (LCD—reflective and transmissive) and micro-electronic mirror systems (MEMS). SLMs are useful as part of display devices. One known type of display device utilizing an SLM is an LCD having a liquid crystal (LC) material which is driven by electronics located under each pixel. There are many known pixel architectures for these devices, each of which utilizes different structures and techniques to drive the LC material. For example, an analog pixel architecture might represent the color value of the pixel with a voltage that is stored on a capacitor under the pixel. This voltage can then directly drive the LC material to produce different levels of intensity on the optical output.

Digital pixel architectures store the pixel value as a digital value in a memory device (e.g., DRAM, SRAM, etc). In this case, the digital information is generally converted to an analog form to drive the LC material. One common approach to such conversion is pulse-width modulation (PWM). For example, PWM is one technique for generating gray scale in an SLM device. In this approach, the LC material is driven by a digital waveform whose active time is a function of the desired gray scale value. With reference to FIG. 1, an example pulse width modulation waveform includes two refresh cycles. Each refresh cycle has a refresh time $t_r$ and each pulse in the refresh cycle has an active time $t_{on}$.

The active time of the PWM waveform, $t_{on}$, is a function, $f_{pwm}$, of the current pixel value, p, where p is an integer value between 0 and $2^n-1$, n is the number of bits in a color component (typically 8 for many computer systems), $t_{on}$ is a number between 0 and $t_r$, and $t_r$ is a refresh time (generally constant). For example, if $f_{pwm}$ is linear, then $t_{on}$ is given by the expression:

$$t_{on} = f_{pwm}(p) = \frac{p}{2^n} t_r \qquad \text{Eq. (1)}$$

The refresh time depends on the response time of the material along with the update rate of the content that the device displays. Ideally, the refresh time should be shorter than that of the content and the minimum active time should be larger than the response time of the LC material.

The active time $t_{on}$ is also time varying as the pixel value p may change over time. It is often desirable to use a non-linear function for $f_{pwm}$ to match this function with other non-linear aspects of the system. Also, to provide for DC-balanced drive of the LC material, the PWM signal may be inverted every other frame before being provided to the LC material (i.e., the active time is active-high during even refresh cycles and active-low during odd refresh cycles).

In some systems, the SLM multiplexes several colors sequentially in time. This type of multiplexing is a common low-cost approach to generating full color from the inherently gray-scale SLM devices. With reference to FIG. 2, an example pulse width modulation waveform includes one refresh cycle for red (R), one refresh cycle for green (G), and one refresh cycle for blue (B). The entire video frame includes three refresh cycles, namely one each for R, G, and B. During each refresh cycle, the SLM displays either red, green, or blue data. Multiplexing several colors onto a single SLM generally requires additional color management hardware and/or software in the display system that is responsible for ensuring that the appropriate color illuminates the SLM at the appropriate point in time. In some systems, two colors are multiplexed onto a first SLM device and the third color is continuously provided to a second SLM device. Also, some colors may be repeated within a particular video frame (e.g. R-R-G-B or R-G-R-B).

BRIEF DESCRIPTION OF THE DRAWINGS

Various features of the invention will be apparent from the following description of preferred embodiments as illustrated in the accompanying drawings, in which like reference numerals generally refer to the same parts throughout the drawings. The drawings are not necessarily to scale, the emphasis instead being placed upon illustrating the principles of the invention.

DESCRIPTION

In the following description, for purposes of explanation and not limitation, specific details are set forth such as particular structures, architectures, interfaces, techniques, etc. in order to provide a thorough understanding of the various aspects of the invention. However, it will be apparent to those skilled in the art having the benefit of the present disclosure that the various aspects of the invention may be practiced in other examples that depart from the these specific details. In certain instances, descriptions of well known devices, circuits, and methods are omitted so as not to obscure the description of the present invention with unnecessary detail.

Figure 1:
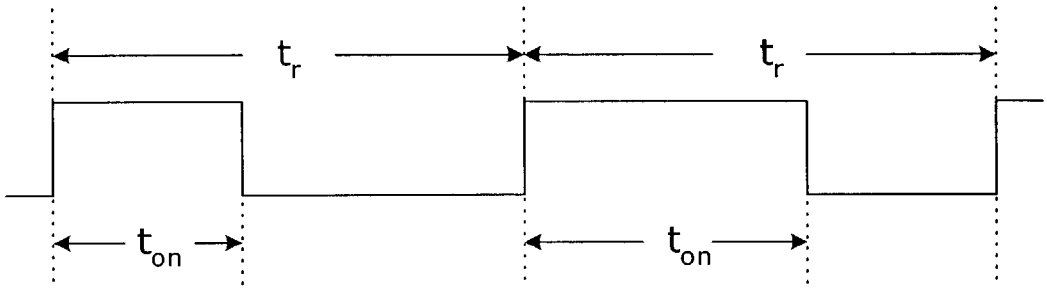
FIG. 1 is a graph of an example pulse width modulation waveform for a spatial light modulator.
Figure 2:
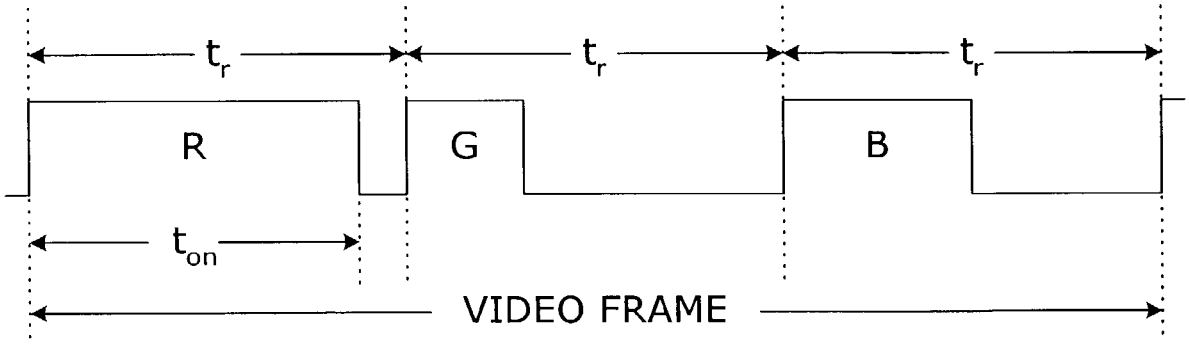
FIG. 2 is a graph of an example pulse width modulation waveform for a sequential color spatial light modulator.
Figure 3:
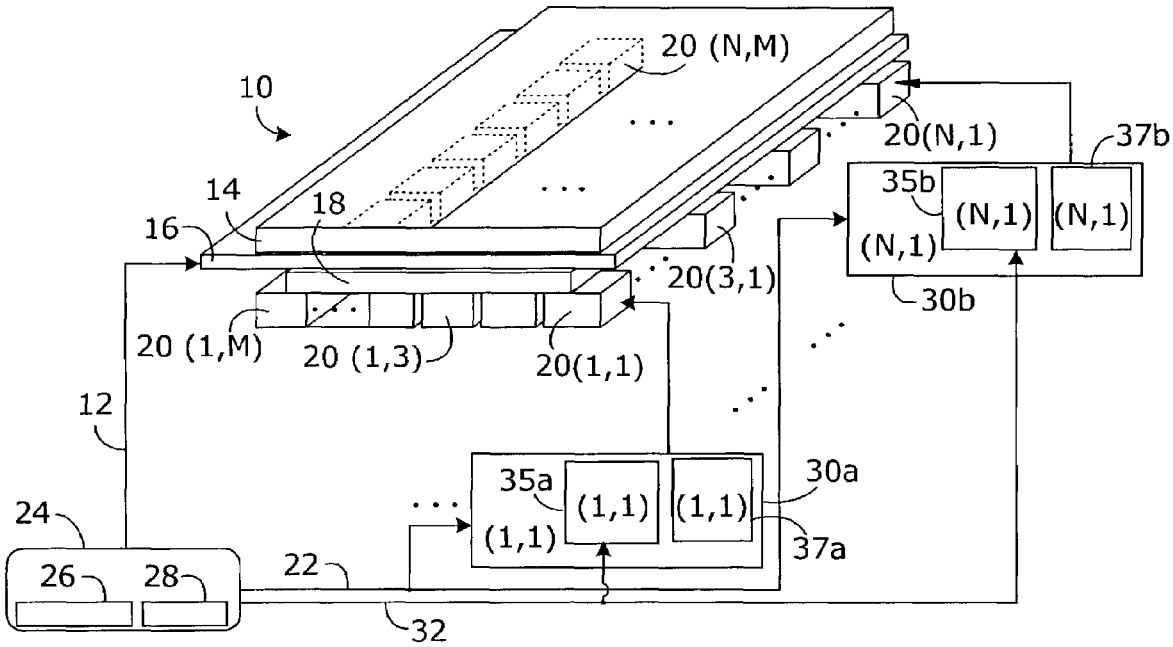
FIG. 3 is a partially schematic, partially perspective view of a display system suitable for utilizing the present invention.

With reference to FIG. 3, a display system 10 (e.g., a liquid crystal display (LCD)), such as a spatial light modulator (SLM) includes a liquid crystal layer 18. In one embodiment, the liquid crystal layer 18 may be sandwiched between a transparent top plate 16 and a plurality of pixel electrodes 20(1, 1) through 20(N, M), forming a pixel array comprising a plurality of display elements (e.g., pixels). In some embodiments, the top plate 16 may be made of a transparent conducting layer, such as indium tin oxide (ITO). Applying voltages across the liquid crystal layer 18 through the top plate 16 and the plurality of pixel electrodes 20(1, 1) through 20(N, M) enables driving of the liquid crystal layer 18 to produce different levels of intensity on the optical outputs at the plurality of display elements, i.e., pixels, allowing the display on the display system 10 to be altered. A glass layer 14 may be applied over the top plate 16. In one embodiment, the top plate 16 may be fabricated directly onto the glass layer 14.

A global drive circuit 24 may include a processor 26 to drive the display system 10 and a memory 28 storing digital information including global digital information indicative of a common reference and local digital information indicative of an optical output from at least one display element, i.e., pixel. Based on a comparison of the global and local digital information, the display system 10 may determine a transition separating a first pulse interval and a second pulse interval in a modulated signal generated for at least one display element, i.e., pixel. Accordingly, from the modulated signal, the display element may be appropriately driven, providing the optical output based on the digital information.

In some embodiments, the global drive circuit 24 applies bias potentials 12 to the top plate 16. Additionally, the global drive circuit 24 provides a start signal 22 and a digital information signal 32 to a plurality of local drive circuits (1, 1) 30*a* through (N, 1) 30*b*, each local drive circuit may be associated with a different display element being formed by the corresponding pixel electrode of the plurality of pixel electrodes 20(1, 1) through 20(N, 1), respectively.

In one embodiment, a liquid crystal over silicon (LCOS) technology may be used to form the display elements of the pixel array. Liquid crystal devices formed using the LCOS technology may form large screen projection displays or smaller displays (using direct viewing rather then projection technology). Typically, the liquid crystal (LC) material is suspended over a thin passivation layer. A glass plate with an indium tin oxide (ITO) layer covers the liquid crystal, creating the liquid crystal unit sometimes called a cell. A silicon substrate may define a large number of pixels. Each pixel may include semiconductor transistor circuitry in one embodiment.

One technique in accordance with an embodiment of the present invention involves controllably driving the display system 10 using pulse-width modulation (PWM). More particularly, for driving the plurality of pixel electrodes 20(1, 1) through 20(N, M), each display element may be coupled to a different local drive circuit of the plurality of local drive circuits (1, 1) 30*a* through (N, 1) 30*b*, as an example. To hold and/or store any digital information intended for a particular display element, a plurality of digital storage (1, 1) 35*a* through (N, 1) 35*b* may be provided, each digital storage may be associated with a different local drive circuit of the plurality of local drive circuits (1, 1) 30*a* through (N, 1) 30*b*, for example. Likewise, for generating a pulse width modulated waveform based on the respective digital information, a plurality of PWM devices (1, 1) 37*a* through (N, 1) 37*b* may be provided in order to drive a corresponding display element. In one case, each PWM device of the plurality of PWM devices (1, 1) 37*a* through (N, 1) 37*b* may be associated with a different local drive circuit of the plurality of local drive circuits (1, 1) 30*a* through (N, 1) 30*b*.

The global drive circuit 24 may receive video data input and may scan the pixel array in a row-by-row manner to drive each pixel electrode of the plurality of pixel electrodes 20(1, 1) through 20(N, M). Of course, the display system 10 may comprise any desired arrangement of one or more display elements. Examples of the display elements include spatial light modulator devices, emissive display elements, non-emissive display elements and current and/or voltage driven display elements.

As noted above, pulse-width modulation (PWM) may be utilized for generating color in an SLM device. This enables pixel architectures that use pulse-width modulation to produce color in SLM devices. In this approach, for example, the LC material is driven by a signal waveform whose "ON" time is a function of the desired color value.

More specifically, one embodiment of the display system 10 may be based on a digital system architecture that uses pulse-width modulation to produce color in spatial light modulator devices arranged in a matrix array comprising a plurality of digital pixels, each digital pixel including one or more sub-pixels. In one case, the matrix array may include a plurality of columns and a plurality of rows. The columns and rows may be driven by a separate global drive circuit, which may enable localized generation of a pulse width modulated voltage or current waveforms at a digital pixel level to drive the plurality of digital pixels. Alternatively, the plurality of digital pixels may be configured in any other useful or desirable arrangement.

In essence, to digitally drive the digital pixels according to the present invention, one operation may involve storing respective digital information received over the digital information signal 32 at each digital storage 37 associated with a different local drive circuit 30, for driving an associated pixel electrode 20 of the corresponding display element, for example. To indicate the lengths of the first and second pulse intervals forming the modulated signal, a particular timing providing a desired transition may be derived based on the digital information. In turn, the lengths of the first and second pulse intervals of the modulated signals may control the optical output of each display element within a refresh period.

For some embodiments, providing the local digital information may include dynamically receiving video data associated with each display element. However, receiving the video data, in one embodiment, includes programmably receiving at least one pixel value for each display element. The digital information may be programmably stored in at least one register associated with each display element. Then, for each display element, a duration of illumination, i.e., an "ON" time within the refresh period may be caused based on the length of the first pulse interval of the modulated signal.

When the display element receives the global and local digital information, the global digital information may be compared to the local digital information to determine a desired timing for a particular single transition in the modulated signal. As a result, this comparison may cause the particular single transition to occur in the modulated signal applied to the display element. Moreover, by varying the duration of application of the modulated signal to the display element, however, an optical output from the display element may be selectively adjusted based on this comparison. This selective adjustment feature may be utilized to compensate for a display non-linearity of one or more display elements in one embodiment. To further non-linearly modulate the optical output from the display element, the particular single transition may also be selectively delayed.

Without limitation, a pixel source may be a computer system, graphics processor, digital versatile disk (DVD) player, and/or a high definition television (HDTV) tuner. In addition, a pixel source may not provide pixel data for all of the pixels in the display system. For example, the pixel source may simply provide the pixels that have changed since the last update since in some embodiments having appropriate storage for all the pixel values, it will ideally know the last value provided by the pixel source.

Figure 4:
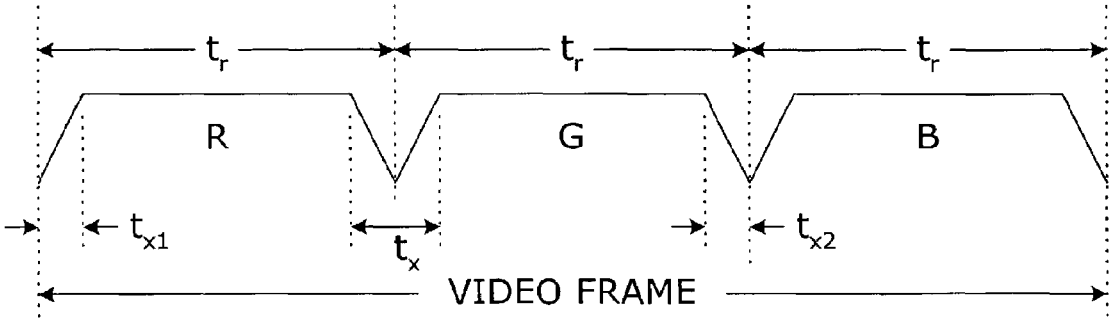
FIG. 4 is a graph of relative light intensity of a light engine for a spatial light modulator.

A light engine generally include a light source together with suitable optics, filters, and other components and circuits for illuminating a target (e.g. the SLM device). Ideally, the light intensity from a light engine changes instantaneously and is constant for the refresh time. However, an aspect of the present invention involves a problem that occurs because the light engine may not perform ideally. For example, due to practical limitations with the light engine in a sequential color system, the transitions between colors are not instantaneous. The light intensity takes a non-zero portion of the refresh time to reach its respective 100% and 0% intensities. With reference to FIG. 4, a representative illustration shows how the light engine takes some time to transition between colors during a frame of video data, with the portions of the graph having increasing and decreasing slopes indicating periods of transition between intensities. Under these circumstances, the PWM waveform may not provide its active pulse during an optimal time from the standpoint of the light engine.

As used herein, a transition time $t_x$ may include either a transition time $t_{x1}$ for transition from high intensity to low intensity, or a transition time $t_{x2}$ for transition from low intensity to high intensity, or both. The transition time $t_{x1}$ is not necessarily equal to $t_{x2}$ and the various transition times $t_x$ for respective refresh cycles are not necessarily equal. The transitions from high to low intensity and from low to high intensity may correspond to the transitions between colors in a sequential color system. For example, the transition time $t_x$ corresponds to an amount of time required by the light engine to transition from 100% intensity of red light to 100% intensity of green light. Without limitation, the transition delays in the light engine may be caused by a sequential color wheel, a spiral color wheel, a liquid crystal shutter, or another characteristic of the light engine requiring some response time or transition between refresh cycles.

One example of the present invention relates to a method for using PWM drive in a manner that complements system-level behaviors in light engines. For example, the method has particular utility for display systems based on SLM devices that are time-multiplexed between two or more colors.

If the start or end of the active time pulse is coincident with either the start or end time of the refresh cycle, the resulting light output is less bright than is desired because the illumination is not at 100% intensity for the entire active time $t_{on}$ of the pulse corresponding to the pixel value. Particularly for a low gray-scale pixel value (e.g. a pixel value having a corresponding short duration active time), the transition period of the light engine may coincide with a significant portion of the active time pulse. In one example of the invention, this problem is overcome by offsetting the active time of the pulse in the refresh cycle by an amount of time corresponding to a transition time of the light intensity. In other words, the pulse corresponding to the pixel value does not start until the light intensity is 100%. The present example of the invention thus provides higher brightness for pixel values having pulse widths for which the transition time represents a significant fraction of the active time.

Figure 5:
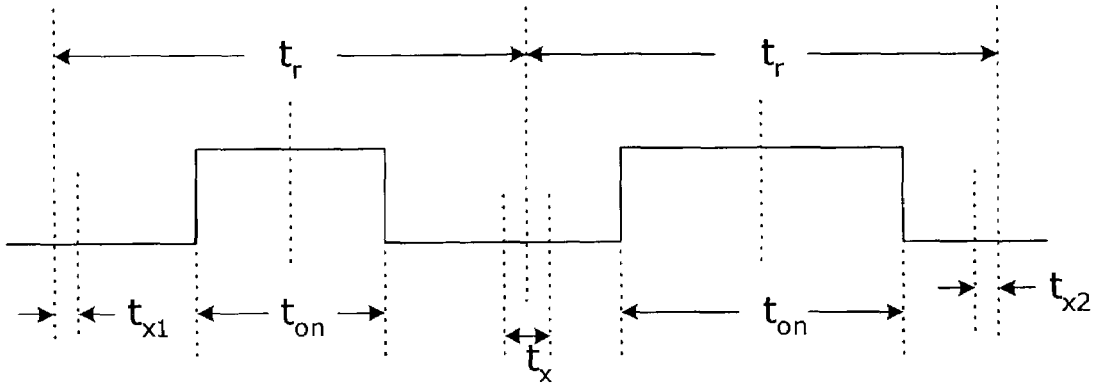
FIG. 5 is a graph of an example pulse width modulation waveform for a spatial light modulator in accordance with some embodiments of the present invention.

With reference to FIG. 5, an example PWM waveform in accordance with the present invention includes pulses having active times ton which are offset from (e.g. not coincident with) the start time and the end time of the refresh cycle. As illustrated in FIG. 5, the pulses have an active time $t_{on}$ which is centered with respect to the refresh time $t_r$ and accordingly is offset with respect to a transition time $t_x$ of the light engine. Centering the PWM active time ensures that short duration PWM intervals are driven with the maximum available intensity light. Moreover, centering the PWM active time ensures that all but the longest duration PWM intervals completely avoid the transition time.

Figure 6:
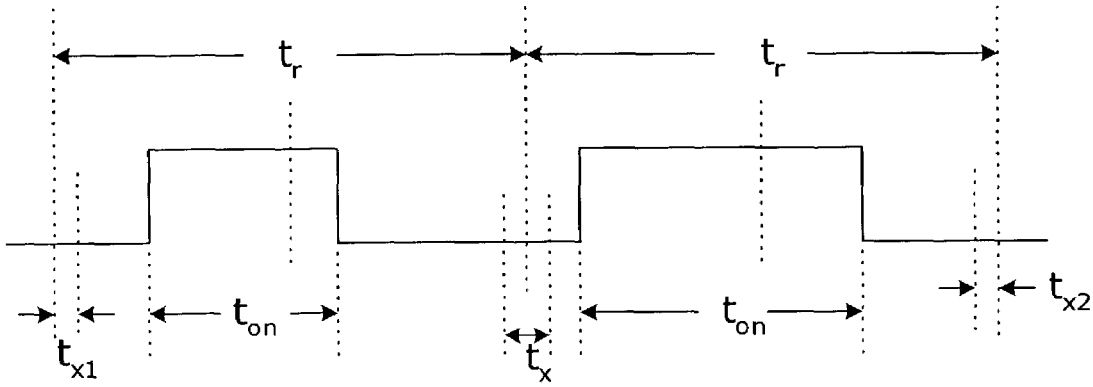
FIG. 6 is a second graph in accordance with the present invention of an example pulse width modulation waveform for a spatial light modulator.
Figure 7:
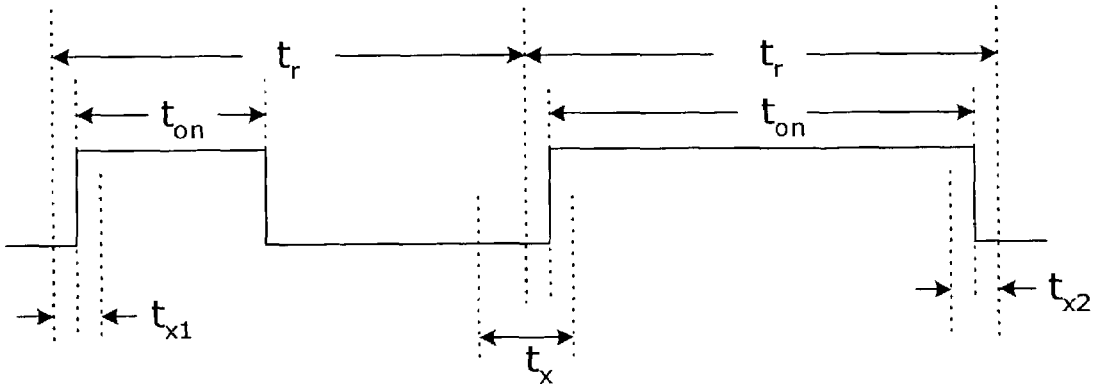
FIG. 7 is a third graph in accordance with the present invention of an example pulse width modulation waveform for a spatial light modulator.

While centering of the active time pulse is a preferred example, other non-centered examples include offsetting the pulse by an amount sufficient to avoid the transition times $t_{x1}$ and/or $t_{x2}$ of the light engine. With reference to FIG. 6, the active time $t_{on}$ of the respective pulses do not overlap with either of the transition times $t_{x1}$ or $t_{x2}$. Other examples include offsetting the pulse by an amount sufficient to avoid at least a portion of the transition time. With reference to FIG. 7, there is a small overlap between the active time $t_{on}$ and the transition time $t_x$, but less overlap than would have been the case if the pulse was coincident with the start of the refresh cycle. As can be seen in the second refresh cycle in FIG. 7, those pixel values having the longest duration pulses may present a situation in which overlap with the transition period cannot be avoided. Preferably, if overlap occurs the pulse is offset to the extent possible towards the relatively higher intensity portion (e.g. >50% intensity) of the transition time.

Figure 8:
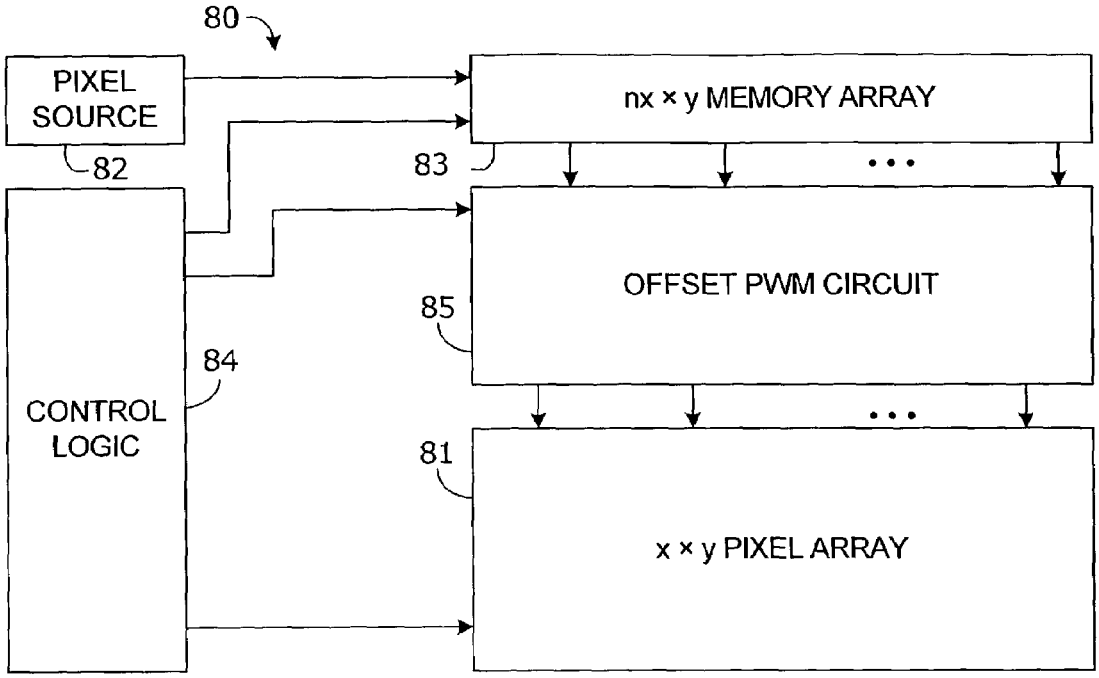
FIG. 8 is a block diagram of a first example pixel architecture including an offset PWM circuit.

With reference to FIG. 8, an SLM system 80 for operating an SLM device includes a pixel array 81 (e.g. an X by Y SLM device). A pixel source 82 provides pixel data to a memory circuit 83. For example the memory circuit 83 is an X by Y memory array of n-bit wide data. A control logic circuit 84 provides control signals to the memory circuit 83 and also to an offset PWM circuit 85. The offset PWM circuit 85 receives signals from the memory circuit 83 and provides signals to drive the pixel array 81. In operation, the offset PWM circuit 85 functions as described above to offset the PWM drive signals from both the start time and the end time of the refresh cycle.

Figure 9:
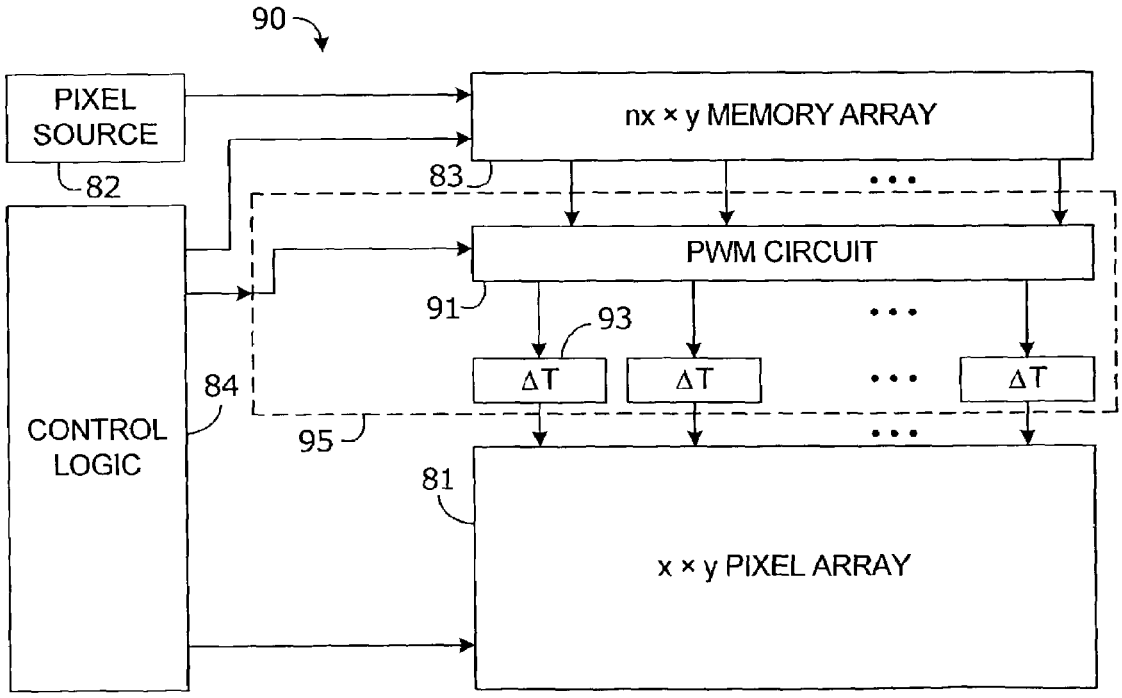
FIG. 9 is a block diagram of a second example pixel architecture including an offset PWM circuit.

With reference to FIG. 9, one implementation of the present invention, which is compatible with existing PWM schemes, delays the PWM signal prior to driving the pixel element. The SLM system 90 is generally as described above in connection with FIG. 8, with like numbered parts having the same reference numerals. An offset PWM circuit 95 includes a PWM circuit 91 which may include any conventional PWM scheme. The output of the PWM circuit 91 is provided to a set of delay circuits 93 which function to offset the PWM drive signals with respect to the start time and the end time of the refresh cycle. For example, the amount of delay for the delay circuits 93 corresponds to the transition time of the light engine. For example, in a color sequential system the amount of delay may be fixed and set to the greatest transition time for any of the time sequenced colors. Alternatively, the amount of delay may be fixed at an average delay of the transition times for the time sequenced colors, with the compromise that some overlap may occur for the longer transition times. Alternatively, the amount of delay may be programmable and set for each refresh cycle in accordance for the transition time associated with the color corresponding to the particular refresh cycle.

For a fixed amount of delay, the longer duration pulses may undesirably extend beyond the refresh cycle. This can be accounted for by selectively bypassing the delay circuit 93 for those pulses or adapting the PWM circuit 91 to limit the length of the longer duration pulses to remain within the refresh cycle. For a programmable delay circuit 93, the amount of delay may be set to zero or another small amount which causes the active time pulse to overlap with the transition time for the longer duration pulses without spilling into the next refresh cycle.

Figure 10:
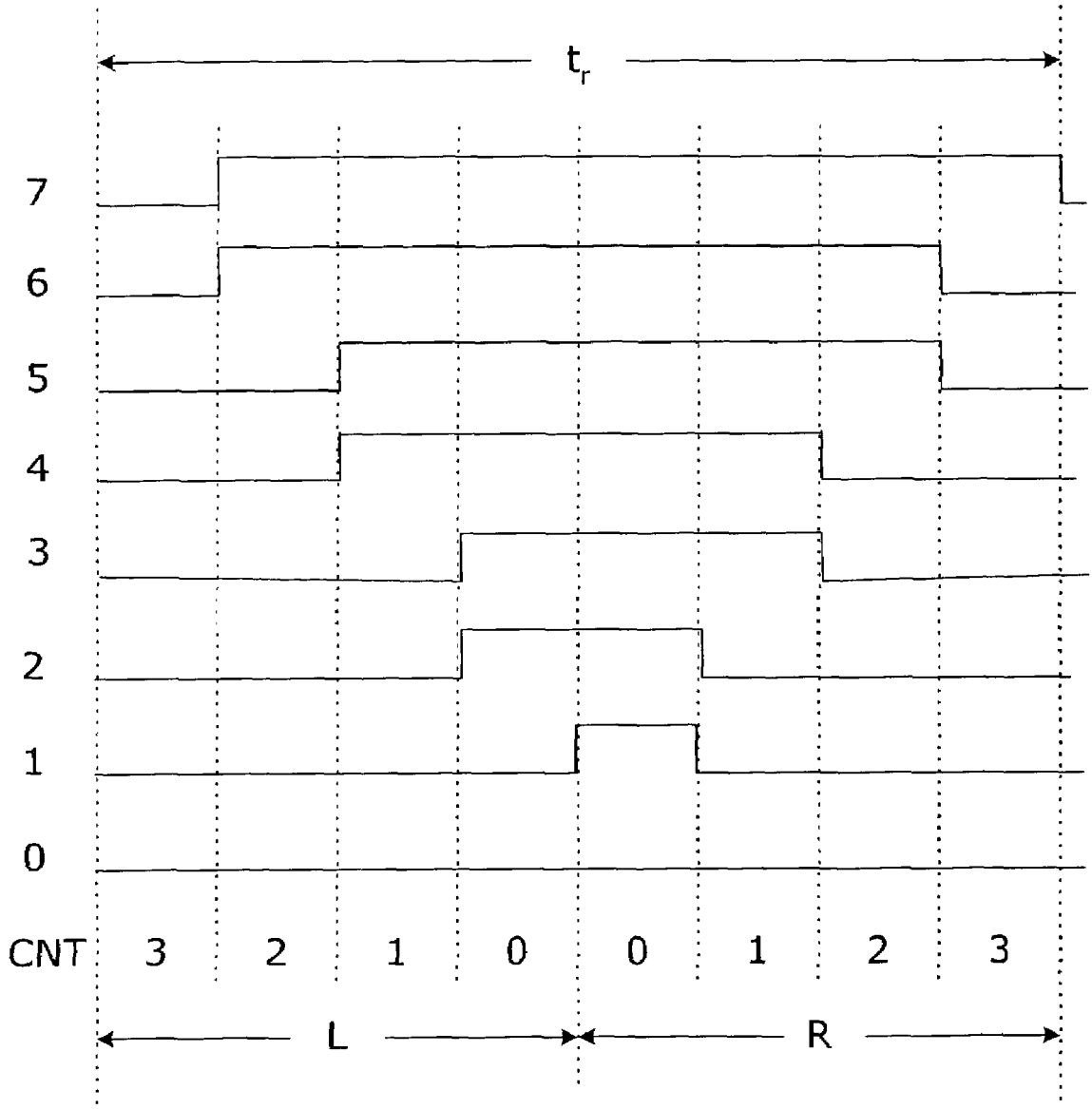
FIG. 10 is a fourth graph in accordance with the present invention of an example pulse width modulation waveform for a spatial light modulator.
Figure 11:
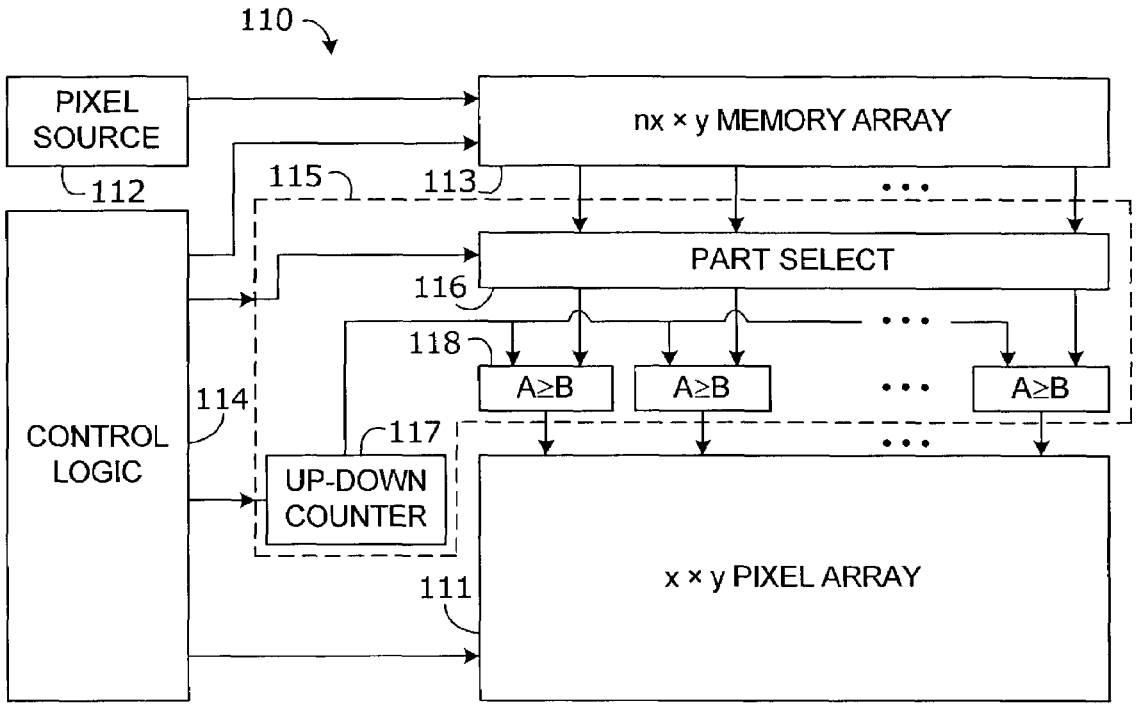
FIG. 11 is a block diagram of a third example pixel architecture including an offset PWM circuit.
Figure 12:
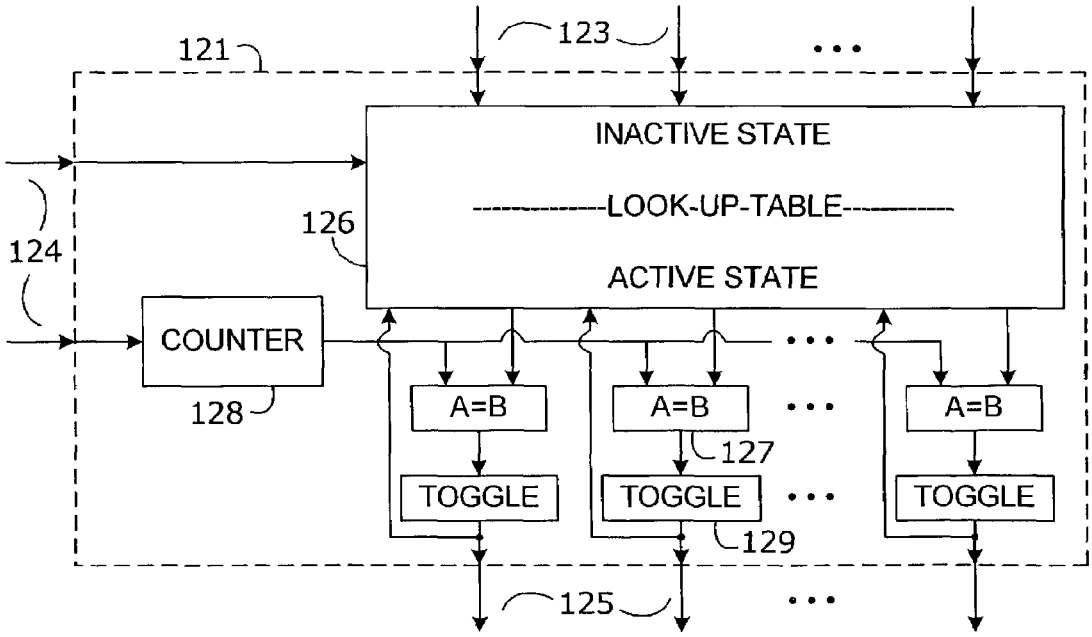
FIG. 12 is a block diagram of another example of an offset PWM circuit.

With reference to FIGS. 10-12, other examples of the invention are implemented with a ramp-based pixel architecture. For example, each of the related applications mentioned above describe different ramp-based pixel architectures.

With reference to FIG. 10, one example of the invention operates by dividing the refresh time into a left part L and a right part R and then further dividing each part into $n_l$ and $n_r$ slices. Typically, all slices are the same duration and $n_l=n_r$. However, slices having different durations and different numbers of slices for the left and right parts may also be used. In the following example, the number of slices $n^l+n_r=2^n$ where n is the number of bits in a color component (e.g. typically 8, but n=3 in this example). However, the number of slices does not necessarily have any relationship with the number of bits in the color component.

The present example includes a counter value CNT that counts off the slices. For the left part L, the counter value CNT is in the range $[0, n_l-1]$ and counts in a monotonically-decreasing fashion from $[n_l-1]$ to 0 (e.g. from 3 to 0). For the right part R, the counter value CNT is in the range $[0, n_r-1]$ and counts in a monotonically-increasing fashion from 0 to $[n_r-1]$ (e.g. from 0 to 3).

During each slice, the invention determines the appropriate state of the PWM waveform by comparing the counter value CNT to a comparison value derived from the pixel value P. In general terms, larger pixel values P will be generate pulses which are active for proportionately more slices. The active pulses in the left part L are right justified (e.g. shifted away from the start time of the refresh cycle) and the active pulses in the right part R are left justified (e.g. shifted away from the end time of the refresh cycle). Specifically, during the intervals in the left part L of the refresh time the PWM state for a pixel of value P given a counter value of CNT is:

$$CNT<f1_{pwm}(0.5\times P)\Rightarrow PWM \text{ active; OR}$$

$$CNT\geqq f1_{pwm}(0.5\times P)\Rightarrow PWM \text{ inactive;}$$

and for intervals in the right part R of the display, the state is:

$$CNT<f2_{pwm}(0.5\times P)\Rightarrow PWM \text{ active; OR}$$

$$CNT\geqq f2_{pwm}(0.5\times P)\Rightarrow PWM \text{ inactive;}$$

where $f1_{pwm}$ (p) is the floor of p; i.e., the largest integer less-than or equal-to p, and $f2_{pwm}$ (p) is the ceiling of p; i.e., the smallest integer greater-than or equal-to p (where in the above example, p=0.5×P).

With the foregoing conditions, a pixel with an odd pixel value P will be active for m intervals in the left part and m+1 intervals in the right part. If desired, the functions can be readily re-defined so that an odd pixel value is active for m+1 intervals in the left part and m intervals in the right part. In operation, the floor function $f1_{pwm}$ is applied during the left part L of the refresh cycle and the ceiling function $f2_{pwm}$ is applied during the right part R of the refresh cycle.

FIG. 10 illustrates PWM waveforms for the case where $n_l$ and $n_r$ are 4 using the above floor and ceiling functions to determine the proper state for the PWM waveform for pixel values P=0 through 7 and the counter value CNT goes from 3 to 0 and back.

With reference to FIG. 11, an SLM system 110 for an SLM device includes a pixel array 111 (e.g. an X by Y SLM device). A pixel source 112 provides pixel data to a memory circuit 113. For example the memory circuit 113 is an X by Y memory array of n-bit wide data. An offset PWM circuit 115 is connected between the memory circuit 113 and the pixel array 111. The offset PWM circuit 115 includes a part select circuit 116, a ramp counter 117, and a set of comparator circuits 118. A control logic circuit 114 provides control signals to the memory circuit 113 and also to the part select circuit 116 and the ramp counter 117. The part select circuit 116 receives signals from the memory circuit 113 and provides signals to the comparator circuits 118. The ramp counter 117 also provides a signal to the comparator circuits 118. The output of the comparator circuits 118 are the PWM signals used to drive the pixel array 111.

In operation, the pixel state is determined by comparing a pixel comparison value with a ramp value. For example, the ramp counter 117 is a 2-bit up-down counter which counts from 0 to 3 and back. The part select circuit 116 functions to select either the left part L of the refresh cycle or the right part R of the refresh cycle and to provide the appropriate pixel comparison value. For example, during the left part L, the part select circuit 116 performs the floor function (e.g. $f1_{pwm}$ described above) and provides the result of that function as the pixel comparison value. During the right part R, the part select circuit R performs the ceiling function (e.g. $f2_{pwm}$ described above) and provides the result of that function as the pixel comparison value. For example, the signal provided by the control logic circuit 114 indicates to the part select circuit 116 whether the ramp counter 117 is counting down (e.g. the left part L) or counting up (e.g. the right part R). The comparator circuits 118 then compare the respective pixel comparison values with the output value of the ramp counter 117 and drive the pixel array 111 accordingly.

For example, the part select circuit 116 may comprise a look-up-table (LUT) which implements the floor function (f1) and the ceiling function (f2). The entries of the LUT correspond to pre-calculated results for the floor and ceiling functions on 0.5 times the associated pixel value. The LUT is divided into two halves with the lower order half representing the floor function and the higher order half representing the ceiling function. The LUT is then indexed (e.g. addressed) by a combination of the pixel value and a part select signal from the control logic circuit. Entries in the LUT for the lower half correspond to the result of the floor function for the associated pixel value. For the present example, the LUT may be configured as follows:

| Part Select Signal | Pixel Value | LUT entry |
|---|---|---|
| 0 | 0 | 0 |
| 0 | 1 | 0 |

-continued

| Part Select Signal | Pixel Value | LUT entry |
|---|---|---|
| 0 | 2 | 1 |
| 0 | 3 | 1 |
| 0 | 4 | 2 |
| 0 | 5 | 2 |
| 0 | 6 | 3 |
| 0 | 7 | 3 |
| 1 | 0 | 0 |
| 1 | 1 | 1 |
| 1 | 2 | 1 |
| 1 | 3 | 2 |
| 1 | 4 | 2 |
| 1 | 5 | 3 |
| 1 | 6 | 3 |
| 1 | 7 | 4 |

where the Part Select Signal is provided from the control logic circuit with a value of 0 designating the left part of the refresh cycle and a value of 1 designating the right part of the refresh cycle. The LUT entries for the lower half of the table (e.g. when the part select signal is 0) correspond to the result of the floor function performed on 0.5 times the pixel value. LUT entries for the upper half of the table (e.g. when the part select signal is 1) correspond to the result of the ceiling function performed on 0.5 times the pixel value.

With reference to FIG. 12, an offset PWM circuit 121 receives signals 123 from a memory circuit and also receives signals 124 from a control logic circuit and provides drive signals 125 to a pixel array. Each refresh cycle is divided into a plurality of slices. The offset PWM circuit 121 functions to offset the active pulse from the start time and the end time of the refresh cycle by delaying the active pulse for a specified number of slices and then providing the active pulse for a specified number of pulses. One example implementing this circuit is illustrated in FIG. 12. Each pixel value has two associated entries in a LUT 126. For example, the first entry may correspond to the counter value at which the pulse goes active and the second entry may correspond to the counter value at which the pulse goes inactive. The LUT 126 receives signals 123 and 124 from the memory circuit and the control logic circuit and provides a comparison value to a set of comparison circuits 127. A counter 128 receives another signal 124 from the control logic circuit and provides a counter value to the comparison circuits 127. The comparison circuits 127 compare the counter value with the comparison value (e.g. the counter value when the pulse should change states) and provides a signal to a set of toggle circuits 129. The output of the toggle circuits 129 provides the PWM drive signals 125 and is also used to index the LUT 126. For example, when the toggle output is 0, the comparison value corresponds to the first LUT entry indicating the counter value when the pulse should go active. When the toggle output is 1, the comparison value corresponds to the second LUT entry indicating the counter value when the pulse should go inactive.

In an alternative example, the first entry in the LUT may correspond to the number of OFF slices and the second entry may correspond to the number of ON slices, with corresponding changes in the associated circuitry. Given the benefit of the present specification, other examples of the invention may be readily implemented for use with the systems described in the above-mentioned related applications as well as other pixel architectures. Also, while the above examples are particularly useful for display devices, the invention may be practiced with a wide variety of devices including communication devices or other information processing devices utilizing spatial light modulators.

With each of the foregoing examples, those pixel values with short duration pulses are illuminated with higher light intensity. Moreover, substantially all pixel values correspond to pulses having no overlap with the transition time. Accordingly, the pixels are illuminated with more light intensity and the foregoing examples of the invention make better use of the illumination characteristics of color management systems in SLM systems, particularly those with time multiplexed pixel elements.

The foregoing and other aspects of the invention are achieved individually and in combination. The invention should not be construed as requiring two or more of the such aspects unless expressly required by a particular claim. Moreover, while the invention has been described in connection with what is presently considered to be the preferred examples, it is to be understood that the invention is not limited to the disclosed examples, but on the contrary, is intended to cover various modifications and equivalent arrangements included within the spirit and the scope of the invention.

What is claimed is:

1. A system, comprising:

a spatial light modulator including at least one pixel;

a pixel source including pixel data corresponding to the pixel;

a memory circuit connected to the pixel source and configured to store a pixel value corresponding to the pixel data;

a pulse width modulation circuit connected between the memory circuit and the spatial light modulator, the pulse width modulation circuit adapted to generate a pulse to drive the pixel of the spatial light modulator, wherein a duration of the pulse corresponds to the pixel value and wherein the pulse is offset with respect to a start time and an end time of a refresh cycle of the spatial light modulator; and a control circuit connected to at least one of the memory circuit, the spatial light modulator, and the pulse width modulation circuit.

2. The system as recited in claim 1, wherein the pulse width modulation circuit generates the pulse centered with respect to the refresh cycle.

3. The system as recited in claim 1, further comprising: a light engine adapted to illuminate the spatial light modulator, wherein an amount the pulse is offset is in accordance with an operating characteristic of the light engine.

4. The system as recited in claim 3, wherein the light engine is adapted to sequentially transition through two or more colors and wherein the operating characteristic corresponds to a transition time between colors.

5. The system as recited in claim 1, wherein the pulse width modulation circuit comprises a delay circuit configured to provide the offset.

6. The system as recited in claim 1, wherein the pulse width modulation circuit comprises a part select circuit configured to divide the refresh cycle into a plurality of parts, the part select circuit being further configured to apportion the duration of the pulse between the plurality of parts of the refresh cycle.

7. The system as recited in claim 6, wherein the plurality of parts includes at least a first part and a second part of the refresh cycle and the pulse width modulation circuit comprises an up-down counter, and wherein the up-down counter is adapted to count up during the first part of the refresh cycle and down during the second part of the refresh cycle.

8. The system as recited in claim 7, wherein a state of the pixel is determined by comparing a value stored in the part select circuit with a value of the up-down counter.

9. The system as recited in claim 1, wherein the pulse width modulation circuit comprises a look-up-table having at least a first entry and a second entry corresponding to the pixel value, wherein the first entry corresponds to an inactive state for the pulse and the second entry corresponds to an active state for the pulse.

10. A method of pulse width modulating a pixel of a spatial light model atom comprising:

reading a pixel value from a pixel source;

offsetting an active time of a signal with respect to a start time and an end time of a refresh cycle, wherein a duration of the offset signal corresponds to the pixel value; and driving the pixel of the spatial light modulator with the offset signal.

11. The method as recited in claim 10, wherein the offset signal is centered with respect to the refresh cycle.

12. The method as recite in claim 10, wherein the spatial light modulator is illuminated by a light engine and wherein an amount of time the offset signal is offset is in accordance with an operating characteristic of the light engine.

13. The method as recited in claim 12, wherein the light engine sequentially transitions through two or more colors and wherein the operating characteristic corresponds to a transition time between colors.

14. A pulse width modulation circuit, comprising:

a memory adapted to store a pixel value; and a circuit configured to read the pixel value and to generate a pulse having a duration corresponding to the pixel value, the circuit being further configured to offset the pulse with respect to a start time and an end time of a refresh cycle of a spat al light modulator.

15. The pulse width modulation circuit, as recited in claim 14, wherein the circuit generates the pulse centered with respect to the refresh cycle.

16. The pulse width modulation circuit as recited in claim 14, wherein the spatial light modulator is illuminated by a light engine and wherein an amount the pulse is offset is in accordance with an operating characteristic of the light engine.

17. The pulse width modulation circuit as recited in claim 16, wherein the light engine is adapted to sequentially transition through two or more colors and wherein the operating characteristic corresponds to a transition time between colors.

18. The pulse width modulation circuit as recited in claim 14, wherein the circuit comprises a delay circuit configured to provide the offset.

19. The pulse width modulation circuit as recited in claim 14, wherein the circuit comprises a part select circuit configured to divide the refresh cycle into at least a plurality of parts, the part select circuit being further configured to apportion the duration of the pulse between the plurality of pans of the refresh cycle.

20. The pulse width modulation circuit as recited in claim 14, wherein the circuit comprises a look-up-table having at least a first entry and a second entry corresponding to the pixel value, wherein the first entry corresponds to an inactive state for the pulse and the second entry corresponds to an active state fur the pulse.

* * * * *